United States Patent [19]

Drahtmüller

[11] 4,350,079

[45] Sep. 21, 1982

[54] FLUID MOTOR

[75] Inventor: Hans-Dieter Drahtmüller, Aschaffenburg, Fed. Rep. of Germany

[73] Assignee: Linde Aktiengesellschaft, Wiesbaden, Fed. Rep. of Germany

[21] Appl. No.: 125,792

[22] Filed: Feb. 29, 1980

[30] Foreign Application Priority Data

Mar. 2, 1979 [DE] Fed. Rep. of Germany ..... 2908119

[51] Int. Cl.[3] ..... F01B 13/04

[52] U.S. Cl. ..... 91/499

[58] Field of Search ..... 91/472, 499, 492

[56] References Cited

U.S. PATENT DOCUMENTS 2,290,764 7/1942 Neuland ..... 91/507

3,924,515 12/1975 Clark ..... 91/472

FOREIGN PATENT DOCUMENTS 418584 10/1934 United Kingdom ..... 91/472

2054750 2/1981 United Kingdom ..... 91/499

*Primary Examiner*—William L. Freeh

*Attorney, Agent, or Firm*—Yount & Tarolli

[57] ABSTRACT

A fluid machine comprises a housing and a rotary cylinder block in the housing. The rotary cylinder block includes a cylinder in which a piston reciprocates. Valve plate means is connected with the housing and disposed in sliding engagement with the cylinder block. The valve plate means is provided with two arcuate openings. Vanes are placed in the arcuate openings in the valve plate means. The vanes divide the incoming flow into a cylinder into portions having different velocities (both in absolute value and direction). The valves direct each portion of the flow to a different portion of the arcuate opening so that the portions are fed to the cylinder in a sequence such that the velocity of a portion entering the cylinder corresponds to the rate of change of the volume of a chamber defined by the piston and cylinder as the respective portions of flow enters the chamber.

5 Claims, 7 Drawing Figures

γ
64
102
92
62
104
90
76
72
80

10
142
120
140
126
136
13
134
122
128
130
124

102a
52a
92a 104a
72a
90a 52b
102b
104b
92b
72b
90b

FLUID MOTOR

BACKGROUND OF THE INVENTION

The present invention relates to fluid machines, and in particular the present invention relates to fluid motors or pumps which have a rotating cylinder block and which have improved fluid flow into and out of the cylinder block.

There is a known class of fluid machines called axial piston pumps or motors. These machines may be operated as pumps by applying a rotary input to the device and producing thereby a flow of fluid under pressure, or they may be operated as motors by supplying fluid under pressure and deriving a rotary mechanical movement. In the specification which follows and the claims which form a part thereof, the present invention will be described as a pump. It should be understood that the invention applies equally to fluid machines generally, both pumps and motors.

Axial piston pumps of the bent axis type include a housing in which there is a rotary cylinder block having a plurality of at least approximative parallel cylinder bores within which cylinders reciprocate. The pistons extend from the cylinder barrel and are connected with a thrust plate by means of articulated connecting rods. The thrust plate rotates about an axis which intersects and is transverse to the axis of rotation of the cylinder block.

The cylinder barrel has an end face which bears against a valve plate. The valve plate has an inlet port and an outlet port which serve in a well known manner to provide properly phased communication between the cylinders in the cylinder block and the inlet and outlet passages of the device. The surface of the cylinder barrel against which the valve plate abuts may be a polished flat surface, but it may also be a curved surface, especially a spherical surface, and it will be seen that the present invention is applicable equally to both.

Many pumps and motors of the type described have variable displacements, and when operated as pumps can produce a flow in either direction without changing the direction of the rotary mechanical input to the pump. The present invention, however, is suited for fixed-displacement pumps and motors, or at least to machines in which the top and bottom dead center positions of the pistons do not reverse themselves with any possible change of displacement.

Considerable attention has been paid to the flow of fluid into and out of the cylinders of axial piston pumps and motors with a view to reducing frictional losses and improving efficiency. For example, it is already known that because of the rotary movement of the cylinder block, the flow of fluid through the valve plate and into the cylinder block should not be perpendicular to the end face of the cylinder block, instead the flow should be at an angle to this surface. Similarly, the flow of fluid out of the cylinder block should be inclined with respect to the end face of the cylinder block when viewed from a fixed frame of reference. Because of the high speed of the flow, the fluid has kinetic energy associated with it, and this energy can be utilized to increase pump efficiency by the flow is properly guided in the inlet ports of the cylinder barrel and inlet port in an end face of the valve plate and vice versa in case of a motor.

Furthermore, it has been established that the angle of the flow toward or away from the end face of the cylinder block is dependent on the side to which the axis of rotation of the cylinder drum is inclined relative to the plane of rotation of the thrust plate. See, e.g., German Published Application (Auslegeschrift) No. 13 01 712. In the device disclosed therein the flow of fluid into or out of the cylinder block is guided by careful shaping of the passages through the valve plate. The valve plate includes two arcuate, nearly semicircular openings. Two passages lead through the valve plate from external fluid connections, one of the passages leading to each of the arcuate openings. The arcuate openings have a tapered depth when measured parallel to the axis of rotation of the cylinder block. The depth of the arcuate openings at any location is in proportion to the rate of fluid flow to or from the cylinder when the passage leading from the cylinder to the arcuate opening is at that location.

This arrangement of tapered arcuate ports in the valve plate is often difficult to carry out in actual application. In practice it is often required that the external connections to the pump or motor must be made on a surface of the housing which is generally perpendicular with the axis of rotation of the cylinder block. This means the fluid must flow in (or out) of the pump or motor in a direction generally perpendicular to the end surface of the cylinder block. The passage or channel leading fluid into the pump widens circumferentially and narrows radially as it reaches the bottom of the valve plate where it forms the arcuate opening. The external connection with this passage is in the direction of the middle of the opening and as a consequence of the fact that the external connections have been centered with respect to the arcuate opening with which they communicate, one part of the flow must move in a direction away from the original axis of flow and counter to the direction of rotation of the cylinder block, and another part of the flow must move in the opposite direction. But the cylinder block rotates in only one direction, and thus the part of the flow which moved counter to the direction of rotation of the cylinder block must turn approximately 180° in order to enter the cylinder. Moreover, the transistion from a circular channel or passage where the external connections to the valve plate are made to an arcuate opening in the valve plate is so rapid that cavitation and turbulence as well as separation of the flow from the walls are likely to result. This can result in incomplete filling of the cylinder and therefore inefficiency in the pump or motor.

Other attempts have been made to improve the flow of fluid into axial piston machines, whether pumps or motors. U.S. Pat. No. 3,202,101 shows a fixed displacement, swash-plate pump in which the fluid flowing to the port plate is driven by an impeller connected with the cylinder barrel. The impeller has flat blades which extend radially outward from a hub coaxial with the axis of rotation of the cylinder block. The fluid is given a rotary component of motion equal to the speed of the cylinder block and then fed to one of the arcuate openings in the valve plate. This pump occupies a great deal of space in the axial direction, and for this reason the pump may not be suitable for some applications. Further this design does not account for the fact that the arcuate opening in the valve plate extends for less than 180°, nor for the fact that the rate of intake flow into the cylinders varies with the sinusoidal reciprocation of the pistons in the cylinders.

German Disclosure (Offenlegungsschrift) No. 16 53 417 shows an axial piston pump in which the inlet flow is radially inward through channels which rotate with the cylinder block. This gives the flow an appropriate circumferential component but increases the radius of the cylinder block and thus the overall size of the pump. Further, the added weight to the cylinder block and its radial distance from the axis of rotation of the cylinder block increases the rotational moment of inertia of the cylinder block which is a disadvantage when the speed at which the pump is driven varies.

Finally, U.S. Pat. No. 3,223,047 discloses an axial piston pump having a vane dividing the incoming fluid flow, but its purpose is not related to improving the flow characteristics of the incoming fluid but merely to provide a supply of fluid for cooling purposes when the pump is operated at partial capacity.

SUMMARY OF THE INVENTION

The present invention is directed to improving the flow of a fluid flowing into or out of a fluid machine having a cylinder in a cylinder block in which a piston reciprocates at varying speeds. According to the present invention, the fluid flowing into the cylinder is divided into components having different velocities (both absolute value and direction) and these components are fed to the cylinder in a sequence such that the velocity of the component entering the cylinder corresponds to the rate of change of the volume of a chamber defined by the piston and cylinder as that component enters the chamber. Further, the incoming flow is guided so that it is moving circumferentially in an arcuate opening of a valve plate at the same rate as the cylinder block sweeping past the opening.

The present invention is carried out by placing vanes in the arcuate openings in the valve plate. The vanes serve to divide the incoming flow into different components or portions and to direct each portion of the flow to a different portion of the arcuate opening in the valve plate. Further, the vanes change the speed and direction of each portion of the flow according to the rate of change of the volume of the chamber defined by the cylinder and piston as it moves past the corresponding arcuate portion of the arcuate opening in the valve plate.

The vanes improve flow conditions by reducing separation of the flow from the walls and formation of turbulent eddies. This is especially true when the space available in the axial direction of the machine is limited, and thus sharp changes of direction in the fluid flow are required. The vanes reduce energy loss on the intake side of the motor and assure complete filling of the cylinders. Energy losses are reduced because the direction of the flow out of the valve plate corresponds to the direction of motion of the passages in the cylinder block through which the fluid must flow.

An additional advantage is derived by the presence of the vanes. The vanes make the valve plate more rigid because they are integrally formed with the walls which define the arcuate openings in the valve plate. This helps the valve plate to resist distortion caused by fluid pressure within and by loads applied from outside by mounting the pump to a machine by bolts which extend into the valve plate, etc.

BRIEF DESCRIPTION OF THE DRAWINGS

The foregoing and other objects and features of the present invention will become more apparent upon a reading of the specification taken in conjunction with the accompanying drawings wherein.

DESCRIPTION OF PREFERRED EMBODIMENTS OF THE INVENTION

An axial piston machine 10 (FIG. 1) of the bent axis type is designed to drive or be driven by a fluid which may be either liquid or gaseous. Although the machine 10 may either drive the fluid as a pump or be driven by the fluid as a motor, it will be described operating in the pumping mode, but with the understanding that the present invention is equally applicable to a machine operating as a motor.

Figure 1:
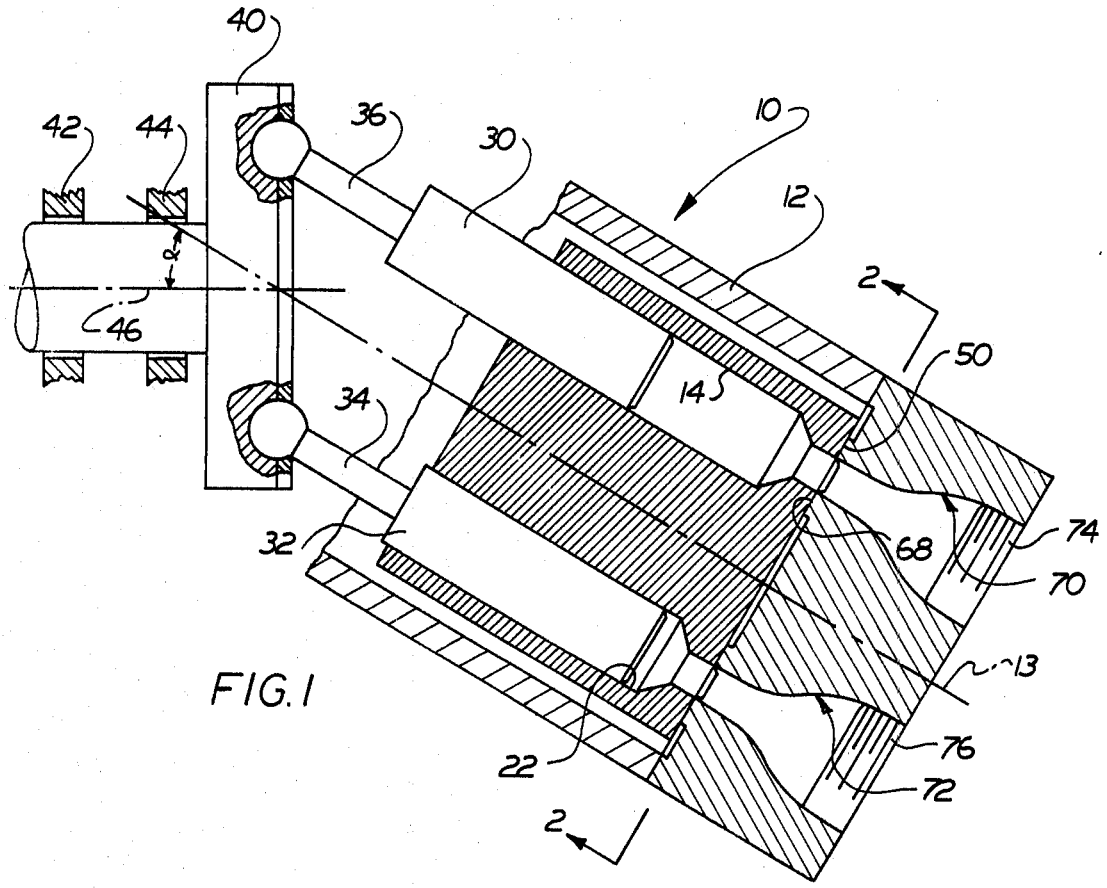
FIG. 1 is a sectional view of an axial piston machine of the bent axis type in a plane containing this axis 13 and the axis 46 and broken at axis 13 showing in the cylinder-barrel two cylinders 14 and 22 and in the valve plate 52 two openings.
Figure 2:
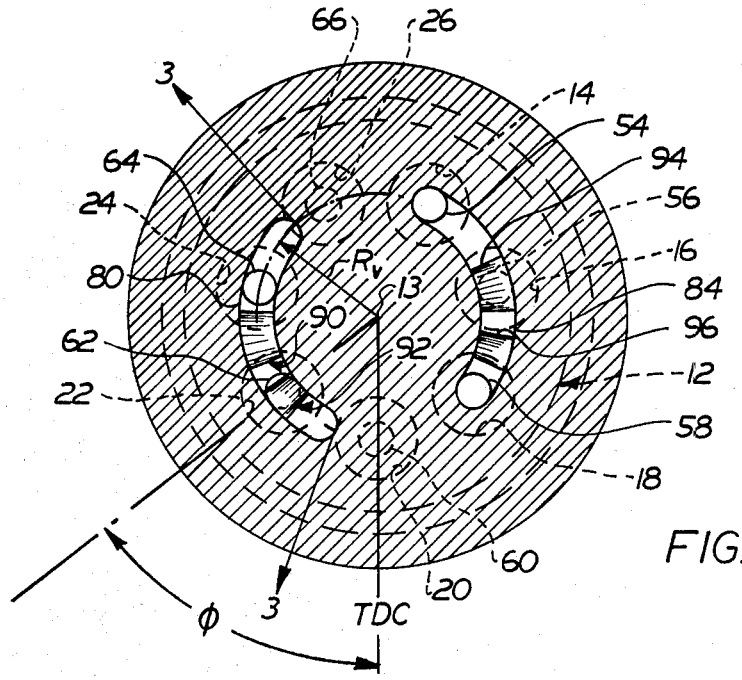
FIG. 2 is a sectional view of the machine of FIG. 1 taken along line 2—2 of FIG. 1.

The machine 10 includes a cylinder block 12 which includes a plurality of cylinders 14, 16, 18, 20, 22, 24 and 26 (FIG. 2). The cylinder block 12 is rotatable about an axis 13. Each cylinder 14–26 is parallel with and equidistant from the axis 13 and each cylinder is provided with a piston which is reciprocatable within. Only pistons 30 and 32 (FIG. 1) which are received in cylinders 14 and 22 are illustrated, but the other pistons are similar. The pistons 30 and 32 are connected by articulated connecting rods 34 and 36 with a drive flange 40. A shaft 38 to which the shaft of the drive flange 40 is mounted is rotatably supported in bearings 42 and 44 and the drive flange is rotatable about axis 46 which is transverse to and intersects axis 13 at an angle $\alpha$. When the machine 10 is operated as a pump, the drive flange 40 is rotated by a prime mover (not shown), and this causes the cylinder block 12 to rotate and the pistons 30 and 32 to reciprocate in a sinusoidal motion within the cylinders 14–26. The cylinders 14–26 and pistons 30 and 32 thus serve to define variable volume chambers within the motor 10.

The cylinder block 12 includes a polished end face 50 which is in sliding engagement with a valve plate 52. The end face 50 is shown as being flat, however it could also be spherical, with the axis 13 intersecting the center of the hemisphere. Further the end face 50 could be only a frustrum of a sphere, the sphere having a radius much larger than the diameter of the cylinder block 12. Either of these would require only minor modification in the present invention. Passages 54, 56, 58, 60, 62, 64 and 66 (FIG. 2) extend between the cylinders 14–26, respectively, and the end face 50 of the cylinder block 12. Fluid flowing into and out of the cylinders 14–26 flows through passages 54–66, respectively.

The valve plate 52 (FIG. 1) is provided with channels 70 and 72 through which fluid is admitted to and discharged from the passages 54–66. The channels 70 and 72 have threaded circular openings 74 and 76, respectively, or other suitable means for connecting an inlet and an outlet conduit (not shown) to the motor 10. The cross sectional shape of each of the channels 70 and 72 changes as it approaches the face 68 of the valve plate 52. At their outer ends 74 and 76 the channels 70 and 72 have a generally circular cross section, and the outer ends of channels define center lines which lie in a plane which includes the axis 13.

At the inner ends, the channels 70 and 72 form arcuate openings 80 and 84 (FIG. 2). The arcuate openings 80 and 84 are positioned radially so that they are aligned with the circular path of the passages 54–62. As the passages 54–62 rotate under and overlap with the arcuate opening 80, fluid is drawn into the cylinders 14–26 by the downward movement of the pistons 30 and 32 therein. Similarly, during the portion of their rotary motion where the passages 14–26 overlap the arcuate opening 84, fluid is expelled from the cylinders. Accordingly, channel 72 is referred to as an inlet channel and channel 70 is referred to as an outlet channel.

The present invention includes vanes 90 and 92 in the inlet channel 72 (and vanes 94 and 96 in the exhaust channel 70) which serve to minimize fluid turbulence friction losses caused by turbulence and improve fluid flow conditions to thereby improve efficiency of the machine 10. The vanes 90 and 92 (FIG. 3) serve to guide the fluid flowing through the channel 72 and into arcuate opening 80 for efficient flow characteristics. The vanes 90 and 92 are integrally formed with the valve plate 52 and have end portions 100 and 102 which direct the flow of fluid toward the passages 54–66 (FIG. 2) in a direction which is a function of the circumferential speed of the passages and of the linear speed of the pistons 30 and 32 in the cylinders.

For maximum efficiency and minimum fluid friction loss the proper velocity of any particle of fluid passing from the arcuate opening 80 into one of the passages 54–66 is the vector sum of the circumferential velocity of the passage and the axial velocity of the piston 30 or 32 at the moment the particle enters the passage multiplied by the ratio of the areas of the piston 30, 32 and passage 54–66. (The vector representing the axial velocity of the piston 30 or 32 must be multiplied by the ratio of the cross sectional area of the cylinders 14–26 to the cross sectional area of the passages 54–66.) Because the motion of the pistons 30 and 32 is sinusoidal, the flow speed in the passages 54–66 depends on the angular position of the one of the cylinders 14–26 which the particle is entering, the position measured from top dead center position of the piston. (This angle is hereafter referred to as the angle $\phi$ and is illustrated in FIG. 2 for the piston 32 in cylinder 22.)

In one specific motor 10, the angle $\alpha$ (FIG. 1) is about 28°, and the circumferential speed is about double the maximum piston speed. When this specific motor is operated at a constant rpm, even though the piston speed changes between nearly zero and its maximum machine 10 during the time the corresponding passage is aligned with the arcuate opening in the valve plate, the relative value of the velocity for a particle entering the passage from the arcuate opening varies only about 10%–15%. This follows simply from the mechanics of the fixed axial piston machine 10.

Because of the sinusoidal motion of the pistons 30 and 32, the angle of inclination of the end portions 100 and 102 of the vanes 90 and 92 nearest the cylinder block 12 varies along the arcuate extent of the opening 80. This angle of inclination is indicated by $\gamma$. The direction of the proper velocity vector for a particle entering the passage and thus the desired angle $\gamma$ for the end portion 102 or 104 of any vane 90 or 92 is given by the equation:

$$\tan \gamma = (R_{cyl}/R_v)k \sin \alpha \sin \phi$$

Where $\gamma$, $\alpha$, and $\phi$ are the angles mentioned above and $R_{cyl}$ is radial distance between axis 13 and the axis of of the cylinders 14–26, $R_v$ is the average radius of curvature of the openings 80 and 82 in the valve plate 52, and k is a constant related to the flow conditions and is dependent on factors such as the diameter of passages 54–66 and the ratio of that diameter to the diameter of the cylinders 14–26.

It is possible to utilize in the present invention vanes which have the same angle $\gamma$ along the entire extent of the arcuate openings, and in this case it is appropriate to use an average value of $\phi$. However, better results are obtained when each vane is positioned at an angle $\gamma$ which accounts for the piston position as the piston passes under the vane. Further it is possible to utilize vanes constructed according to the present invention in machines which have a movable plate (not shown) between the valve plate 52 and the end face 50 of the cylinder block. In such a case the vanes may be part of the valve plate 52, the additional movable plate or vanes may be formed in both the additional movable plate and the valve plate.

It should be noted that provision of vanes 90 and 92 has additional effect. First it reduces the surface area of the valve plate 52 which is exposed to high pressure by an amount equal to twice the cross sectional area of the vanes, and this is an advantage since the valve plate 52 is thus stronger. However, there is additional friction caused by fluid contact with the vanes 90 and 92, and the vanes reduce the total cross section of the channels 72 and 74 through which fluid can flow. This latter effect can be compensated for by enlarging the arcuate openings 80 and 84. The other side effects are more than compensated for by the increased efficiency which results from the use of the vanes 90 and 92.

Finally, it should be noted that the above description has related primarily to the vanes 90 and 92 in the intake channel 72. It is contemplated that more than two vanes 90 and 92 could be provided or that only one vane could be provided. Further, the present invention contemplates that similar vanes 94 and 96 may also be provided in the exhaust channel 74, and that substantial increases in efficiency will result from this.

Figure 3:
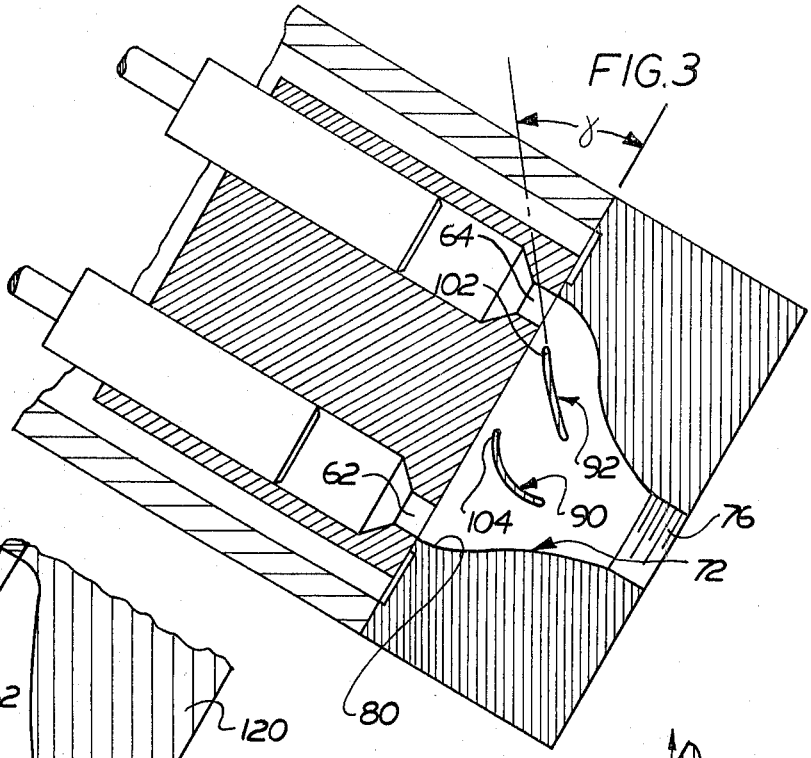
FIG. 3 is a sectional view taken generally along line 3—3 of FIG. 2.
Figure 4:
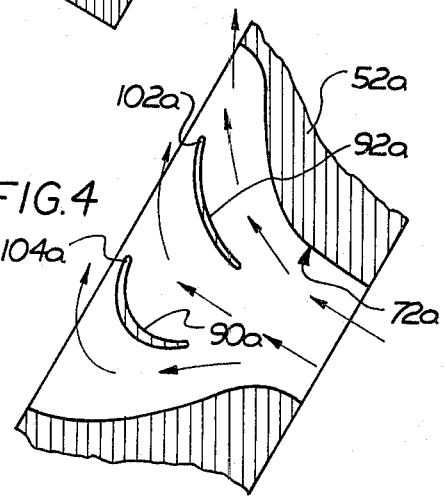
Figure 5:
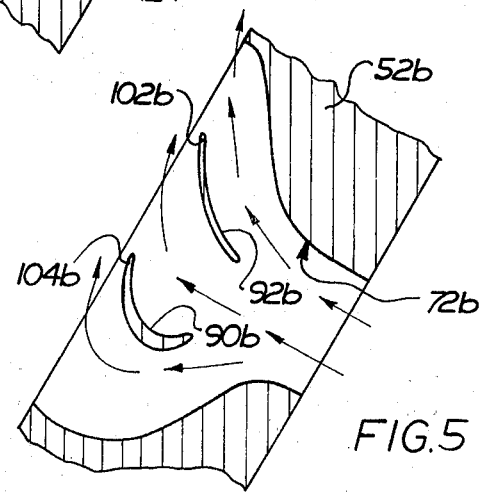

FIGS. 4 and 5 illustrate valve plates **52*a* and 52*b* which are generally similar to the valve plate 52 illustrated in FIG. 3. The embodiments illustrated in FIGS. 4 and 5 differ from the previous embodiments only in the shape of the channels 72*a* and 72*b* and in the shapes of the vanes 90*a*, 92*a*, 90*b* and 92*b*. However, the vanes are provided with end portions 102*a*, 104*a*, 102*b*, 104*b* which are angled according to the same rule as the vanes 102 and 104 described above. Also, the embodiments illustrated in FIGS. 4 and 5 have channels 72*a* and 72*b* which are slightly different from the shape of the channel 72 illustrated in FIG. 3. However, the channels 72*a* and 72*b* function in much the same way as the channel 72**.

Figure 6:
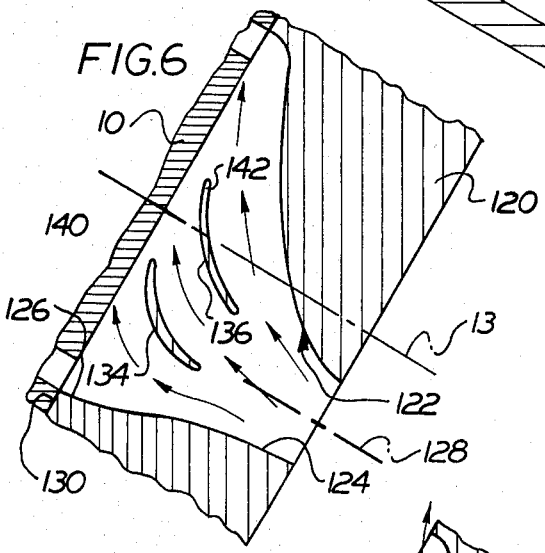
FIGS. 4, 5, 6 and 7 are generally similar to FIG. 3 but illustrate alternative embodiments of the present invention.

FIG. 6 illustrates a valve plate 120 which is generally similar in its overall operation to the valve plate 52 shown in FIG. 3. The valve plate 120 has a channel 122 through which fluid can flow toward the cylinders in the motor 10. However, the valve plate 120 differs from the valve plate 52 in the location of the opening 124 of the channel 122.

The valve plate 120 is intended for use with a machine generally similar to the machine 10 (FIG. 1) and the valve plate 120 will be described as if it were the valve plate 52 shown in FIG. 1 were replaced with the valve plate 120.

The opening 124 of the channel 122 is asymmetrically positioned with respect to the arcuate opening 126 in the end face 130 of the valve plate 120. The arcuate opening 126 is otherwise generally similar to the arcuate openings 80 and 84 shown in FIGS. 1–3. The center line 128 of the upstream opening 124 of the channel 122 is positioned asymmetrically with respect to a plane which includes the axis of rotation 13 of the cylinder block 12 and which also bisects the arcuate opening 126. (Although the axis 13 is shown in FIG. 6, this is for illustrative purposes only since it lies out of the plane of FIG. 6) This asymmetrical arrangement makes it possible to have the connections required for the machine 10 on an end face of the valve plate which is generally perpendicular to the axis of rotation 13 of the cylinder block 12, and nevertheless the direction of flow is not required to be changed abruptly. Furthermore, since the opening 124 is located on the side of the plane previously described which is closest to the beginning of the downward stroke of the piston, little of the fluid entering must have its direction of flow reversed by the vanes 134 and 136. The vanes 134 and 136 are constructed according to the same principles described above in that they have end portions 140 and 142, respectively, which are inclined at an angle designed to provide maximum efficiency in the feeding of fluid from the channel 122 into the cylinders 14–26.

Figure 7:
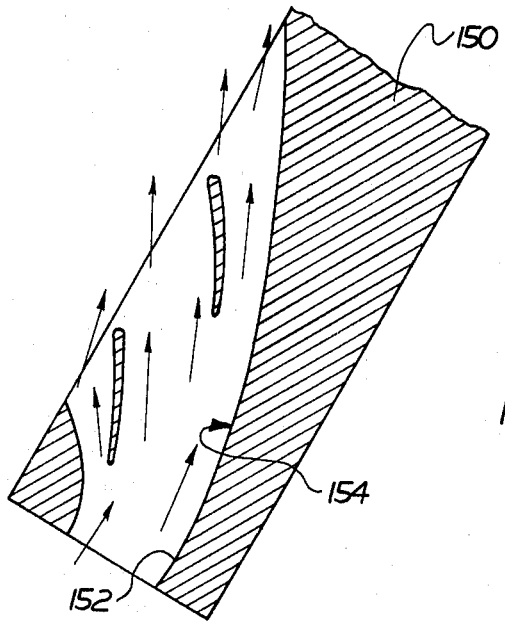

FIG. 7 illustrates a valve plate 150 which is similar in many respects to the valve plates previously described and which is suitable to replace the valve plate 52 on the machines 10 illustrated in FIG. 1. The prime difference between the valve plate 150 and the previously described valve plates lies in the orientation of the opening 152 which forms the upstream end of a channel 154 which corresponds and function to the channel 72 previously described. The opening 152 of channel 154 is in a plane which is parallel to the axis of rotation 13 of the cylinder block 12. Thus the valve plate 150 makes it possible to utilize the present invention where space in the axial direction is extremely limited. Furthermore, the opening 152 is positioned so that the overall direction of flow is generally favorable. Vanes 156 and 158 are constructed according to the principles described above and serve the same functions.

What is claimed is:

1. A fluid machine comprising a housing, a cylinder block disposed in said housing and rotatable about a first axis, a cylinder in said cylinder block parallel to and spaced from said first axis, a piston axially slidable in said cylinder, said cylinder block including an end face and a passage communicating between said cylinder and said end face, valve plate means connected with said housing and disposed in slidable engagement with said end face of said cylinder block for controlling of flow of fluid through said passage, said valve plate means including first and second arcuate openings concentric with said first axis, said arcuate openings being radially aligned with said passage in said cylinder block whereby fluid may flow between said passage and one or the other of said arcuate openings during the portion of the rotation of said cylinder block in which said passage overlaps with said opening, first and second channels in said valve plate means establishing fluid communication between the exterior of said housing and a respective one of said first and second arcuate openings, drive means for rotating said cylinder block and for effecting reciprocating motion of said piston in said cylinder at varying speeds to draw fluid into and expel fluid from said cylinder, and flow guiding means for guiding the flow of fluid through at least one of said channels to different portions of the one of said arcuate openings with which said one of said channels communicates according to the velocity of said piston as said passage rotates by a corresponding one of said arcuately extending portions of said arcuate opening, including at least one vane disposed in one of said channels in said valve plate means and adjacent said arcuately extending opening, said vane including a portion toward said end face of said cylinder block, said portion of said vane being inclined at an angle $\gamma$ with a plane perpendicular to said first axis, wherein said angle $\gamma$ satisfies the formula:

$$\tan \gamma = (R_{cyl}/R_v)k \text{ Sin } \alpha \text{ Sin } \phi$$

where:

$R_{cyl}$ = radial distance between said first axis of rotation of said cylinder block and the center line of said cylinder;

$R_v$ = the average radius of curvature of said arcuate openings in said valve plate means;

$\phi$ = the angular rotational position of said cylinder block with respect to a top dead center position of said piston in said cylinder;

$\alpha$ = the angle between said first axis and said second axis; and k = a constant.

2. A fluid machine as set forth in claim 1 wherein said drive means includes a drive member rotatable about a second axis transverse to and intersecting said first axis.

3. A fluid machine as set forth in claim 1 further including a plurality of cylinders circumferentially spaced from said one cylinder and parallel therewith, each of said plurality of cylinders having a piston axially slidable therein.

4. A fluid machine comprising a housing, a cylinder block disposed in said housing and rotatable about a first axis, a cylinder in said cylinder block parallel to and spaced from said first axis, a piston axially slidable in said cylinder, said cylinder block including an end face and a passage communicating between said cylinder and said end face, valve plate means connected with said housing and disposed in slidable engagement with said end face of said cylinder block for controlling of flow of fluid through said passage, said valve plate means including first and second arcuate openings concentric with said first axis, said arcuate openings being radially aligned with said passage in said cylinder block whereby fluid may flow between said passage and one or the other of said arcuate openings during the portion of the rotation of said cylinder block in which said passage is circumferentially aligned with said opening, first and second channels in said valve plate means establishing fluid communication between the exterior of said housing and a respective one of said first and second arcuate openings, said channels in said valve plate means extending generally parallel to the axis of rotation of said cylinder, drive means for rotating said cylinder block and for effecting reciprocating motion of said piston in said cylinder at varying speeds to draw fluid into and expel fluid from said cylinder, and means for guiding the flow of fluid through at least one of said channels to different portions of the one of said arcuate openings with which said one of said channels communicates according to the velocity of said piston as said passage rotates by a corresponding one of said arcuately extending portions of said arcuate opening, said means for guiding the flow including at least one vane disposed in said one of said channels in said valve plate means and adjacent said arcuately extending opening, said vane including a portion toward said end face of said cylinder block and inclined at an angle $\gamma$ (gamma) with a plane perpendicular to said first axis, wherein said angle $\gamma$ (gamma) satisfies the formula:

$$\tan \gamma = (R_{cyl}/R_v)\ k \operatorname{Sin} \alpha \operatorname{Sin} \phi$$

where:

$R_{cyl}$=radial distance between said first axis of rotation of said cylinder block and the center line of said cylinder;

$R_v$=the average radius of curvature of said arcuate openings in said valve plate means;

$\phi$=the angular rotational position of said cylinder block with respect to a top dead center position of said piston in said cylinder;

$\alpha$=the angle between said first axis and said second axis; and k=a constant.

5. A fluid machine as set forth in claim 4 wherein said fluid motor includes a plurality of cylinders parallel to and circumferentially spaced from said one cylinder, each of said plurality of cylinders having a piston axially slidable therein.

* * * * *

UNITED STATES PATENT AND TRADEMARK OFFICE

CERTIFICATE OF CORRECTION

PATENT NO. : 4,350,079

DATED : September 21, 1982

INVENTOR(S) : Hans-Dieter Drahtmuller

It is certified that error appears in the above–identified patent and that said Letters Patent are hereby corrected as shown below:

Column 1, line 63, change "by" to --if--.

Column 5, line 52, change "machine 10" to --value--.

Signed and Sealed this

*Twenty-second* Day of *March 1983*

[SEAL]

*Attest:*

GERALD J. MOSSINGHOFF

*Attesting Officer*

*Commissioner of Patents and Trademarks*